US010207165B2

(12) United States Patent
Krueger

(10) Patent No.: US 10,207,165 B2
(45) Date of Patent: Feb. 19, 2019

(54) BUMPER GOLF GAME SYSTEM AND RELATED METHODS

(71) Applicant: Gary Krueger, Selkirk, NY (US)

(72) Inventor: Gary Krueger, Selkirk, NY (US)

( * ) Notice: Subject to any disclaimer, the term of this patent is extended or adjusted under 35 U.S.C. 154(b) by 0 days.

(21) Appl. No.: 15/803,454

(22) Filed: Nov. 3, 2017

(65) Prior Publication Data

US 2018/0117434 A1 May 3, 2018

Related U.S. Application Data

(60) Provisional application No. 62/416,797, filed on Nov. 3, 2016.

(51) Int. Cl.
*A63B 67/02* (2006.01)
*A63F 7/06* (2006.01)
*A63F 7/00* (2006.01)

(52) U.S. Cl.
CPC ..... *A63B 67/02* (2013.01); *A63F 7/0005* (2013.01); *A63F 7/0628* (2013.01); *A63F 7/0668* (2013.01)

(58) Field of Classification Search
CPC ..... A63B 67/02
USPC ..... 473/157–164, 166, 167, 181, 185
See application file for complete search history.

(56) References Cited

U.S. PATENT DOCUMENTS 1,582,237 A * 4/1926 Angell ..... A63B 67/02 473/158
2,025,183 A * 12/1935 Stayton ..... A63B 67/02 473/162
3,464,704 A * 9/1969 Nelson ..... A63B 67/02 273/127 R
3,856,313 A * 12/1974 Tierney ..... A63B 67/02 273/125 R
4,596,391 A * 6/1986 Carolan, Jr. ..... A63B 67/02 473/158
4,877,250 A * 10/1989 Centafanti ..... A63B 67/02 273/DIG. 13
4,934,704 A * 6/1990 Mazer ..... A63F 7/0628 473/158
4,957,288 A * 9/1990 Kantner ..... A63B 67/02 473/159
5,316,302 A * 5/1994 Sedberry ..... A63F 7/0628 273/108.21
5,413,344 A * 5/1995 Darden ..... A63B 67/02 473/158

(Continued)

*Primary Examiner* — Mark S Graham
(74) *Attorney, Agent, or Firm* — Heslin Rothenberg Farley & Mesiti P.C.; Kristian E. Ziegler; Matthew Hulihan

(57) ABSTRACT

A bumper golf game system, and related methods, are disclosed. The system includes a flexible putting mat including inner and outer surfaces, first and second goal recesses extending at least partially through the mat, an array of a plurality of central obstacle recesses extending at least partially through the mat positioned generally between the first and second goal recesses, a pair of first goal obstacle recesses extending at least partially through the mat flanking the first goal recess, and a pair of second goal obstacle recesses extending at least partially through the mat flanking the second goal recess. The system also includes a plurality of obstacles configured to mount within the obstacle recesses and extend past the inner surface of the mat. The system further includes a plurality of rails configured to interconnect and extend over the inner surface of the mat to bound a portion thereof.

20 Claims, 2 Drawing Sheets

(56) References Cited

U.S. PATENT DOCUMENTS

| | | | | | |
|---|---|---|---|---|---|
| 5,516,108 | A * | 5/1996 | Foster | A63B 67/02 | 473/158 |
| 5,692,963 | A * | 12/1997 | Holcombe | A63B 67/02 | 473/158 |
| 5,749,789 | A * | 5/1998 | Karl | A63B 67/02 | 473/158 |
| 8,951,135 | B1 * | 2/2015 | Guyer | A63B 67/02 | 473/153 |
| 2004/0204256 | A1 * | 10/2004 | Francisco | A63B 67/002 | 473/3 |
| 2007/0178985 | A1 * | 8/2007 | Ting | A63B 67/02 | 473/157 |
| 2007/0259727 | A1 * | 11/2007 | Westaway | A63B 67/02 | 473/157 |

* cited by examiner

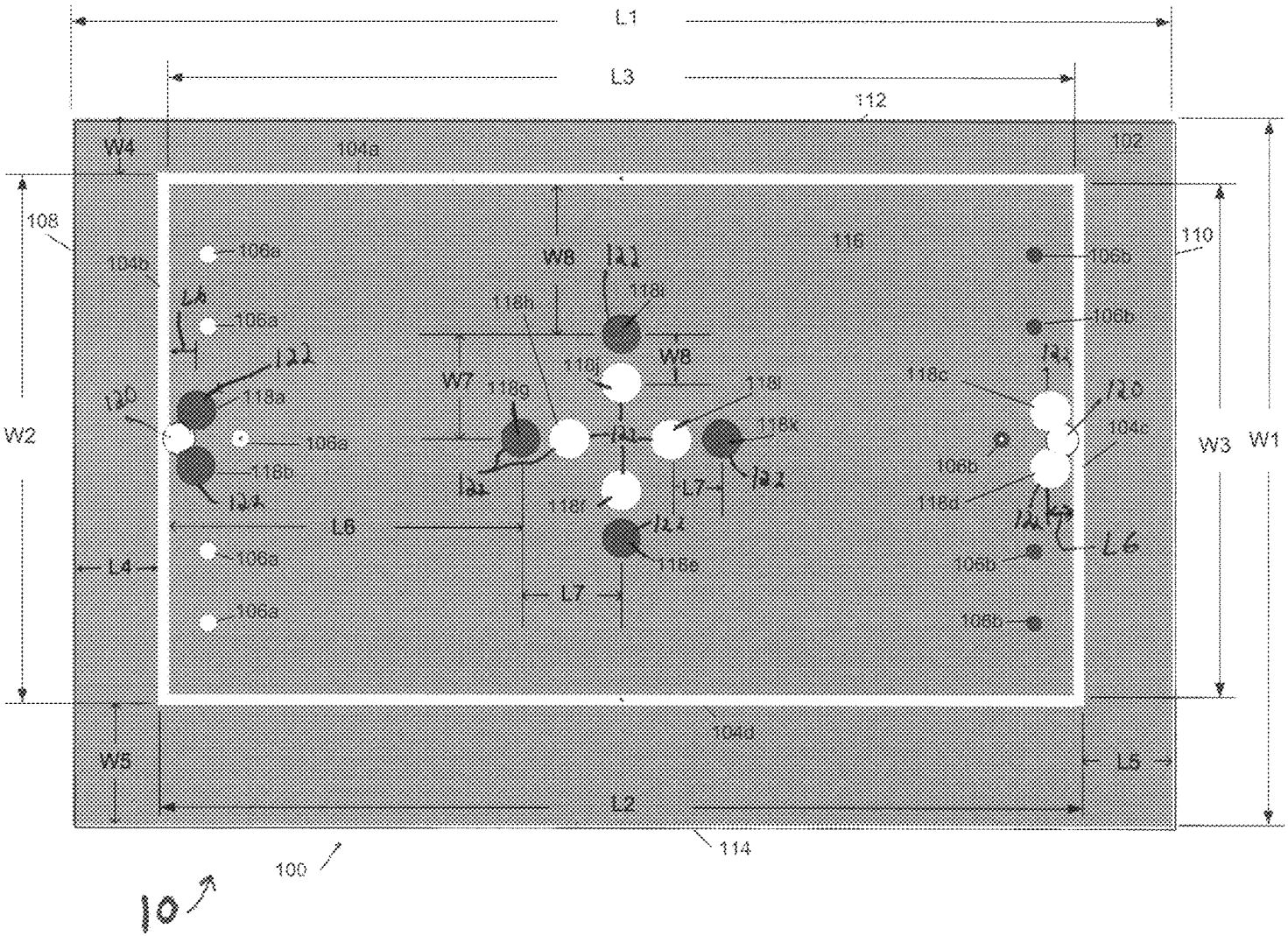
W1
W3
110
L1
L3
112
114
L2
100
10
W2
108
W4
W5
L4
L8
L7
W7
W8
L5
L6
L9
L10
L11
L12
L13
L14
L15
L16
L17
L18
L19
L20
L21
L22
L23
L24
L25
L26
L27
L28
L29
L30
L31
L32
L33
L34
L35
L36
L37
L38
L39
L40
L41
L42
L43
L44
L45
L46
L47
L48

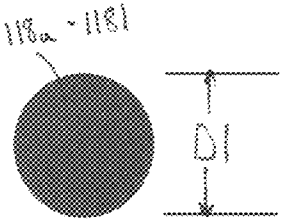
FIG. 2A
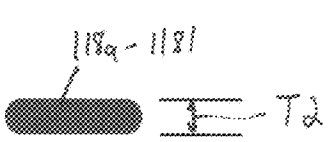
FIG. 2B
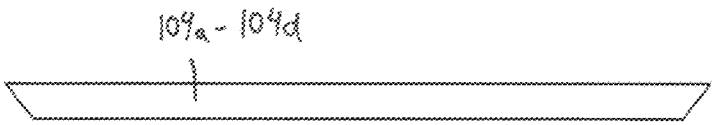
FIG. 3A
FIG. 3B
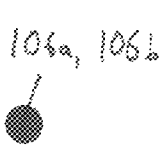
FIG. 4
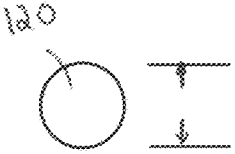
FIG. 5A
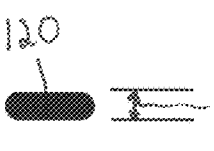
FIG. 5B
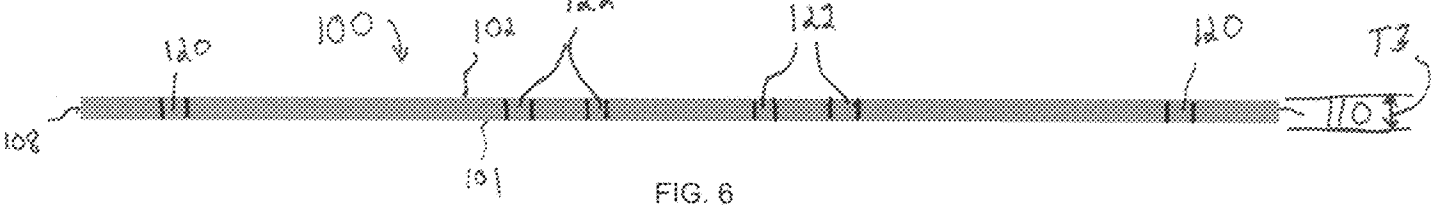
FIG. 6

BUMPER GOLF GAME SYSTEM AND RELATED METHODS

CROSS-REFERENCE TO RELATED APPLICATION

This application perfects and claims the benefit of U.S. Provisional Patent Application No. 62/416,797, filed on Nov. 3, 2017, and entitled Bumper Golf, which is hereby expressively incorporated herein by reference in its entirety.

FIELD OF THE DISCLOSURE

The present disclosure generally relates to a golf bumper game and related methods. More particularly, the present disclosure relates to a bumper golf game system and related methods that includes fixed bumpers or obstacles within a playing surface and surrounded by side rails that is portable, easily constructed, durable and challenging and fun to play.

BACKGROUND

Bumper pool is a pocket billiards game of skill played with pool cues on an octagonal or rectangular elevated table fitted with an array of fixed cushioned obstacles, called bumpers, at the center of its surface. The table is elevated such that the players stand on a ground surface next to the table while playing. A pool cue is an elongated hand-held stick or rod that tapers toward tip at one end for striking a pool ball as the cue is axially translated into the ball by a user. A bumper pool table has two pockets, placed opposite one another, located at the center of two of the rails. Most bumper pool tables have twelve bumpers, although some tables have fourteen or sixteen. Two bumpers typically flank each pocket, and the remaining bumpers are arranged in a cross in the center of the table, with one line of the cross in line with the pockets. At the center of the cross, there is an open space just large enough to allow a ball to pass through. Bumper pool tables with fourteen bumpers commonly have three rather than two bumpers on each side of the center space on the line midway between the two holes.

A bumper pool game is typically played with a cue stick used by a player to strike 5 red or 5 white balls, with one marked ball in each set. At the start of play, each set of balls is typically arranged on five spots near each edge of the table by a pocket with the marked ball placed directly in front of the pocket. An object of the game is for a player to sink all of their balls into their pocket via the cue stick at the opposite end of the table. The game's rules require that a player's marked ball must be sunk before the player can sink any other balls. Unlike most other billiard games, there is no designated cue ball: each ball can be shot into the specified pocket.

To begin a game of bumper pool, both players typically putt their marked ball simultaneously via a cue stick, banking the ball off the cushion to their right and attempting to sink their ball in their pocket at the other end of the table. If both players sink their first shot, they each select another ball, place it in front of their opponent's pocket, and repeat the simultaneous shot. If both players successfully sink all five of their balls in this fashion the game ends in a draw. If, on the initial simultaneous shot, one player fails to sink his or her marked ball in the pocket, the player who successfully sank a ball or who came closest to his or her own pocket shoots next. A player's turn continues until he or she fails to sink a ball.

Miniature golf and other putting games are games of skill that are enjoyed by children and adults alike. Putting games typically have a defined tee-off area (i.e. the designated starting point) that is separate from a putting surface and a cup positioned therein at a distance from the tee-off area into which a player attempts to roll or "putt" a golf ball with a golf putting club (or "putter"). A putter is hand-held golf club with a relatively short, stiff shaft and a relatively flat head used in a swinging motion to strike the golf ball and cause the ball to roll along the ground/putting surface. The tee-off area, putting surface and cup are positioned on/in a ground surface, and the user walks and stands on the tee-off area or putting surface during each stroke of the putter to hit his or her ball toward the cup.

The object of putting games is to putt their ball into the cup while using as few strokes as possible. Putting games usually challenge the putting skill of the players by the employment of elaborate contour and distractions fixed in or movable into the golfer's putting line between the tee-off area and the cup.

While certain aspects of conventional technologies have been discussed to facilitate this disclosure, Applicant in no way disclaims these technical aspects, and it is contemplated that the claimed inventions may encompass one or more conventional technical aspects.

In this specification, where a document, act or item of knowledge is referred to or discussed, this reference or discussion is not an admission that the document, act or item of knowledge or any combination thereof was, at the priority date, publicly available, known to the public, part of common general knowledge, or otherwise constitutes prior art under the applicable statutory provisions; or is known to be relevant to an attempt to solve any problem with which this specification is concerned.

SUMMARY

The present disclosure provides a bumper golf game system, and related methods, that combine selective features, gameplay, challenge and fun of bumper pool with selective equipment, physical layout, required skill set and fun associated with putting games.

Briefly, the present disclosure provides for a bumper golf game system, and related methods, that includes fixed bumpers or obstacles within a playing surface that is surrounded by side rails, and that is portable, easily constructed, durable and challenging and fun to play. The bumper golf game system may include the use of golf putters and balls (e.g., golf balls), and may be played on a playing surface on which the players stand on to play the game/compete. The system may be played on any of various different playing surfaces or mats, such as but not limited to, a synthetic putting surface, live grass, or an indoor/outdoor carpet. An object of the bumper golf game is for a player to putt all of their corresponding balls (e.g., five golf balls in some embodiments) into a recessed goal on/at an opposite side of the playing surface from the player's starting position (with the obstacles positioned therebetween) before the other player or competitor, as explained further below.

In one aspect, the present disclosure provides a bumper golf game system. The system includes a flexible putting mat including an inner surface, an outer surface, a first goal recess extending at least partially through the mat from the inner surface, a second goal recess extending at least partially through the mat from the inner surface, an array of a plurality of central obstacle recesses extending at least partially through the mat from the inner surface positioned generally between the first and second goal recesses, a pair of first goal obstacle recesses extending at least partially through the mat from the inner surface that flank the first goal recess, and a pair of second goal obstacle recesses extending at least partially through the mat from the inner surface that flank the second goal recess. The system also includes a plurality of obstacles configured to removably mount within the plurality of central obstacle recesses and the first and second goal obstacle recesses and extend past the inner surface of the mat. The system further includes a plurality of rails configured to interconnect and overlie the inner surface of the mat to form a frame that bounds a portion of the inner surface of the mat that includes the plurality of central obstacles, the first goal obstacle recesses, and the second goal obstacle recesses.

In some embodiments, the system further includes a plurality of balls for putting by a player with a putter on the inner surface within the bounded portion of the mat. In some such embodiments, the plurality of balls include a plurality of first balls of a first color scheme and a plurality of second balls of a second color scheme that differs from the first color scheme. In some such embodiments, the plurality of obstacles include a plurality of obstacles of the first color scheme for mounting within the first goal obstacle recess and some of the central obstacle recesses, and a plurality of obstacles of the second color scheme for mounting within the second goal obstacle recess and some of the central obstacle recesses. In some other such embodiments, the inner surface of the mat includes a plurality of first visual indications positioned proximate to the first goal recess indicating an initial position of the plurality of balls of the first color scheme thereon for putting into the second goal recess, and the inner surface of the mat includes a plurality of second visual indications positioned proximate to the second goal recess indicating an initial position of the plurality of balls of the second color scheme thereon for putting into the first goal recess.

In some embodiments, the first and second goal recesses are cylindrical recesses. In some embodiments, the plurality of obstacles each form a convex outer surface. In some such embodiments, the plurality of obstacles each form a cylindrical outer surface. In some embodiments, a cross-sectional shape and size of the plurality of central obstacle recesses and the first and second goal obstacle recesses corresponds to a cross-sectional shape and size of the plurality of obstacles.

In some embodiments, the array of the plurality of central obstacle recesses form a cross pattern in a central portion of the bounded portion of the inner surface of the mat. In some embodiments, at least one of the first and second goal recesses, the first and second goal obstacle recesses, and the plurality of central obstacle recesses extend entirely through the mat. In some embodiments, the first goal recess intersects the first goal obstacle recesses, and the second goal recess intersects the second goal obstacle recesses. In some embodiments, the mat is formed of at least one sheet of material.

In some embodiments, the inner surface of the mat includes a visual indication indicating the positioning of the interconnected rails thereon to form the bounded portion. In some embodiments, the interconnected rails form a continuous rectangular frame to form a rectangular bounded portion of the inner surface of the mat. In some such embodiments, the first goal recess and the first goal obstacle recesses are positioned proximate to a first lateral side of the rectangular bounded portion, and the second goal recess and the second goal obstacle recesses are positioned proximate to a second lateral side of the rectangular bounded portion that opposes the first lateral side thereof. In some embodiments, the mat is reconfigurable between a storage configuration with the mat rolled up upon itself, and a playing configuration with the outer surface overlying a ground surface such that the inner surface is substantially planar.

In some embodiments, the system further includes a plurality of balls and an instruction sheet providing instructions of a method of at least two players playing a game with the system with the object of putting the plurality of balls on the inner surface within the bounded portion with a putter into the first or second goal recesses. In some such embodiments, the instruction sheet includes: arranging a plurality balls associated with a first player of a first color scheme on corresponding visual indictors on the inner surface of the mat that are proximate to the first goal recess, and arranging a plurality balls associated with a second player of a second color scheme that differ from the first color scheme on corresponding visual indictors on the inner surface of the mat that are proximate to the second goal recess; the first player putting a first ball of the first color scheme into a first portion of the rails and toward the second goal recesses via a putter, and the second player putting a first ball of the second color scheme into a second portion of the rails and toward the first goal recesses via a putter, the first and second players putting the respective first balls substantially simultaneously; if neither of the first balls are initially putted into the respective first or second goal recesses, the first and second players alternatingly putting their respective first ball via the putter until it is putted into the respective first or second goal recesses; and after the first balls are putted into the respective first or second goal recesses, the first and second players alternatingly putting their remaining associated balls until one of the players wins the game by putting all of their associated balls into the respective first or second goal recess.

In another aspect, the present disclosure provides a method of forming a bumper golf game. The method includes arranging a flexible putting mat over a ground surface such that an inner surface of the mat forms a substantially planar surface, the mat including a first goal recess extending at least partially through the mat from the inner surface, a second goal recess extending at least partially through the mat from the inner surface, an array of a plurality of central obstacle recesses extending at least partially through the mat from the inner surface positioned generally between the first and second goal recesses, a pair of first goal obstacle recesses extending at least partially through the mat from the inner surface that flank the first goal recess, and a pair of second goal obstacle recesses extending at least partially through the mat from the inner surface that flank the second goal recess. The method further includes positioning obstacles within the plurality of central obstacle recesses and the first and second goal obstacle recesses such that the obstacles extend past the inner surface of the mat. The method also includes interconnecting a plurality of rails on the inner surface of the mat to form a frame that bounds a portion of the inner surface of the mat that includes the plurality of central obstacles, the first goal obstacle recesses, and the second goal obstacle recesses.

Certain embodiments of the presently-disclosed cymbal mounting apparatuses, systems and methods have several features, no single one of which is solely responsible for their desirable attributes. Without limiting the scope of the cymbal mounting apparatuses, systems and methods as defined by the claims that follow, their more prominent features will now be discussed briefly. After considering this discussion, and particularly after reading the section of this specification entitled "Detailed Description," one will understand how the features of the various embodiments disclosed herein provide a number of advantages over the current state of the art.

These and other features and advantages of the present disclosure will become apparent from the following detailed description of the various aspects of the present disclosure taken in conjunction with the appended claims and the accompanying drawings.

BRIEF DESCRIPTION OF THE DRAWINGS

The present disclosure will hereinafter be described in conjunction with the following drawing figures, wherein like numerals denote like elements, aspects or features, and:

FIG. 1 is top view of an exemplary bumper golf game system of the present disclosure;

FIG. 2A is a top view of an exemplary obstacle of the system of FIG. 1;

FIG. 2B is a side view of the exemplary obstacle of FIG. 2A;

FIG. 3A is a top view of an exemplary bumper rail of the system of FIG. 1;

FIG. 3B is an end view of the exemplary bumper rail of FIG. 3A;

FIG. 4 is a side/top view of an exemplary ball of the system of FIG. 1;

FIG. 5A is a top view of an exemplary goal recess of the system of FIG. 1;

FIG. 5B is a side view of the exemplary goal recess of FIG. 5A; and

FIG. 6. is a cross-sectional view of a putting mat of the system of FIG. 1 taken across goal recesses thereof.

DETAILED DESCRIPTION OF THE INVENTION

Aspects of the present disclosure and certain features, advantages, and details thereof are explained more fully below with reference to the non-limiting embodiments illustrated in the accompanying drawings. Descriptions of well-known materials, fabrication tools, processing techniques, etc., are omitted so as to not unnecessarily obscure the present disclosure in detail. It should be understood, however, that the detailed description and the specific example (s), while indicating embodiments of the present disclosure, are given by way of illustration only, and are not by way of limitation. Various substitutions, modifications, additions and/or arrangements within the spirit and/or scope of the underlying inventive concepts will be apparent to those skilled in the art from this disclosure.

The present disclosure provides bumper golf game systems (and related methods) that include fixed bumpers or obstacles within a playing surface that are surrounded by side bumper rails. The systems are portable, easily constructed, durable and challenging and fun to play. The bumper golf game systems may also include the use of golf putters and balls (e.g., golf balls), and may be played on a playing surface on which the players stand on to play the game/compete. A system may be played on, and thereby include, any of various different playing surfaces or mats, such as but not limited to, a synthetic putting surface, live grass, or an indoor/outdoor carpet. In one exemplary embodiment, the systems may include a playing or putting mat. An object of the bumper golf game may be for a player to putt all of their corresponding balls (e.g., five golf balls in some embodiments) into a recessed goal on/at an opposite side of the playing surface from the player's starting position, with the obstacles positioned therebetween, before the other player or competitor.

FIG. 1 depicts an exemplary bumper golf game system 10 in accordance with aspects described herein. The system 10 includes a playing or putting mat, substrate or field 100 that includes or defines an inner, playing or putting surface 102, side bumper rails 104*a*, 104*b*, 104*c*, 104*d* that define a perimeter or frame, and bumpers or obstacles 118*a*-118*l* that act as both an obstacle and beneficial component while playing the game, as shown in FIG. 1. FIG. 1 provides various exemplary layouts, shapes and/or relative dimensions to the components shown, though these are provided merely by way of example and not limitation. The size of the mat 100 and/or playing surface 102 is, in one example, approximately double the size of a standard bumper pool table.

The inner, playing or putting surface 102 of the mat 100 may include or define a width W1 dimension and a length L1 dimension, as shown in FIG. 1. In some embodiments, the width W1 is about 8 feet and the length L1 is about 10 feet. In some embodiments, the mat 100 may include or define a thickness T1, as shown in FIG. 6. In some embodiments, the thickness T1 is about ½ inch. In some embodiments, the inner surface 102 has appropriate markings or visual indications to assist in game assembly/setup and/or gameplay. For instance, markings for perimeter lines where rails 104*a*, 104*b*, 104*c*, 104*d* are placed and locations 106*a*, 106*b* where the golf balls are placed to begin the game may be provided (e.g., silk-screened or via any other appropriate process or otherwise formed) on the inner surface 102, as shown in FIG. 1. The outer surface 101 of the mat 100 that opposes the inner surface 102 may be placed or laid onto the ground so that players can walk on the inner surface 102 during gameplay. Therefore the, material out of which the putting surface is made may be selected accordingly. Example materials include a synthetic putting surface and/or tight-threaded indoor/outdoor carpet. In some embodiments, the inner surface 102 is defined by the mat 100. In some such embodiments, the mat 100 may formed of a flexible material and configured such that when the outer surface 101 overlies a substantially planar ground surface, the inner surface 102 is substantially planar. In some embodiments, the mat 100 may be formed of one or more sheet of material, and/or may be able to be rolled up upon itself for storage when the game is not being played. In some examples, the putting surface 102 is the ground, which may be any of the aforementioned materials/configurations.

The rails 104*a*, 104*b*, 104*c*, 104*d*, which when is use define a perimeter or bounded gameplay area 116 of the inner surface 102, may be unattached to each other, or at least separable from each other, and configured to lie on inner surface 102. FIG. 3A depicts a top view of an example rail 104*a*, 104*b*, 104*c*, 104*d*. It is seen in FIG. 3B that, in one exemplary embodiment, the rails 104*a*, 104*b*, 104*c*, 104*d* may be square in cross-section (e.g., about 1 inch square). The rails 104*a*, 104*b*, 104*c*, 104*d* may be formed of any material, such as wood, plastic or metal (e.g., stainless steel). In some embodiments the rails 104*a*, 104*b*, 104*c*, 104*d* may be hollow, in other embodiments the rails 104*a*, 104*b*, 104*c*, 104*d* may be solid. While four rails 104*a*, 104*b*, 104*c*, 104*d* are illustrated in FIG. 1, the system 10 may include fewer than four rails or greater than four rails. Further, the rails may be fixedly coupled together to form a fixed frame for overlying the inner surface 102, or may be configured to be interconnected or removably coupled to from a reconfigurable or non-permanent frame for overlying the inner surface 102. In some embodiments, the rails 104*a*, 104*b*, 104*c*, 104*d* the define or form a planar and/or linear inner surface. In some other embodiments, at least one of the rails 104*a*, 104*b*, 104*c*, 104*d* may define or form a non-planar and/or non-linear inner surface.

In some embodiments, the plurality of rails 104*a*, 104*b*, 104*c*, 104*d* may be configured to interconnect and overlie the inner surface 102 of the mat 100 to form a frame that bounds the gameplay portion 116 of the inner surface 102 of the mat 100 that (includes a plurality of central obstacle recesses and obstacles therein, a first goal obstacle recesses and obstacles therein, second goal obstacle recesses and obstacles therein, and first and second goal recesses, as described further below). As shown in FIG. 3A, in some embodiments the rails 104*a*, 104*b*, 104*c*, 104*d* may include angled ends (e.g., an angle greater than 45 degrees). The rails 104*a*, 104*b*, 104*c*, 104*d* may configured so that when placed on the playing surface 102 in an operative position with respect to each other they form a rectangular frame, as depicted in FIG. 1. In the example of FIG. 1, longitudinal rails 104*a* and 104*d* may include or define a length L2 and lateral rails 104*b* and 104*c* may include or define a width W2. In some embodiments, the length L2 of the longitudinal rails 104*a* and 104*d* may be about 7 feet, and the width W2 of the lateral rails 104*b* and 104*c* may be about 5 feet. In one exemplary embodiment, the rails 104*a*, 104*b*, 104*c*, 104*d* may include angled ends, length L2 of the longitudinal rails 104*a* and 104*d* may be about 7 feet and 10 inches, and the width W2 of the lateral rails 104*b* and 104*c* may be about 5 feet and 2 inches. In one exemplary embodiment, the rails 104*a*, 104*b*, 104*c*, 104*d* may include squared-off ends, length L2 of the longitudinal rails 104*a* and 104*d* may be about 7 feet and 8 inches, and the width W2 of the lateral rails 104*b* and 104*c* may be about 5 feet and 2 inches.

As shown in FIG. 1, the rails 104*a*, 104*b*, 104*c*, 104*d* may form a frame that bounds a gameplay area 116 of the inner surface 102 of the mat 100. In some embodiments, the gameplay area 116 of the inner surface 102 may include a width W3 and a length L3 that is smaller than the width W1 and a length L1 of the inner surface 102 of the mat 100 (and potentially the mat 100 itself). In one exemplary embodiment, the width W3 of the bounded gameplay portion 116 of the inner surface 102 is about 5 feet, and the length L3 of the bounded gameplay portion 116 of the inner surface 102 is about 7 feet and 8 inches. In some embodiments, as shown in FIG. 1, one or more rail 104*a* may be positioned on the inner surface 102 of the mat 100 and spaced from an adjacent edge 112 of the inner surface 102 a width W4, one or more rail 104*b* may be positioned on the inner surface 102 of the mat 100 and spaced from an adjacent edge 114 of the inner surface 102 a length L4, one or more rail 104*c* may be positioned on the inner surface 02 of the mat 100 and spaced from an adjacent edge 110 of the inner surface 102 a length L5, and one or more rail 104*d* may be positioned on the inner surface 102 of the mat 100 and spaced from an adjacent edge 108 of the inner surface 102 a width W5. In one exemplary embodiment, the width W4 is about 10 inches, the width W5 is about 24 inches, and/or the length L4 and the length L5 are about 13 inches.

The bumpers or obstacles 118*a*-118*l* may be substantially solid and/or stiff (e.g., formed from metal (e.g., aluminum) or other appropriate material), and configured with a convex and/or smooth rounded outer surface, which may promote maximum "bounce" for the balls 106*a*, 106*b* when the balls 106*a*, 106*b* collide with the bumpers 118*a*-118*l*. In some embodiments, the bumpers 118*a*-118*l* form a cylindrical outer surface as shown in FIGS. 2A and 2B. However, the bumpers 118*a*-118*l* may be of any shape or configuration. In some embodiments, the bumpers 118*a*-118*l* may include a circular cross-section (e.g., be cylindrical) of a diameter D1, as shown in FIG. 2A. In one such exemplary embodiment, the diameter D1 of the bumpers 118*a*-118*l* may be about 5 inches. In some embodiments, the bumpers 118*a*-118*l* may include an aperture or hole extending from a bottom surface thereof into the bumpers 118*a*-118*l* for/with a stake or pin for affixing the bumpers 118*a*-118*l* to the mat or playing surface 100. As shown in FIG. 2B, the bumpers 118*a*-118*l* may define a thickness T2. In one exemplary embodiment, the thickness T2 of the bumpers 118*a*-118*l* may be within the range of about 1 inch to about ½ inch. In some embodiments, the bumpers 118*a*-118*l* may include a thickness T2 such that they extend past the inner surface 102 when coupled or mounted with the mat 100, as explained further below. In one exemplary embodiment, the bumpers 118*a*-118*l* extend about 1 inch above the inner surface 102 of the mat 100 when mounted therein/thereon.

In some embodiments, the bumpers 118*a*-118*l* may be of a generally disc-shape with substantially parallel opposing sides and semicircular ends, as shown in FIGS. 2A and 2B.

The bumpers 118*a*-118*l* may be provided on (e.g., lie upon), or at least partially embed in, the inner surface 102 in the gameplay area 116. The mat 110 in the gameplay area 116 may include recesses 122 that extend at least partially through the mat 100 from the inner surface 102 toward the outer surface 101, as shown in FIGS. 1 and 6. In some embodiments, the recesses 122 may extend entirely through the thickness T1 of the mat 100, while in other embodiments the recesses 122 may extend only through a portion of the thickness T1 of the mat 100. In some embodiments, bumpers 118*a*-118*l* and the recesses 122 may correspond to each other such that the bumpers 118*a*-118*l* can be removably seated, positioned or maintained within corresponding recesses 120 such the inner surface extends to (or very close to), the outer surface of the bumpers 118*a*-118*l* when the bumpers 118*a*-118*l* are within the recesses 122. In some embodiments, a cross-sectional shape and size of the recesses 122 corresponds to a cross-sectional shape and size of the bumpers 118*a*-118*l*. The recesses 122 may act to physically support the bumpers 118*a*-118*l* to maintain their position and/or orientation on the mat 100, for example.

In some embodiments where the inner surface 102 is the ground (permanent putting green, live grass, etc.), the system 10 may include a template and the bumpers 118*a*-118*l* may be laid on the ground surface 102. In such an embodiment, the bumpers 118*a*-118*l* may be removably coupled to the ground surface 102, such as with double-sided tape and any other appropriate fastener/adhesive.

As shown in FIG. 1, in one exemplary layout of the mat 100, the system 10 includes first goal bumpers 118*a*, 118*b* and corresponding recesses 122 that are centered along the width W2 of the lateral rail 104*b*, and the centers thereof spaced a length L6 from the interior side/edge of rail 104*b*. Similarly, the second goal bumpers 118*c*, 118*d* and corresponding recesses 122 that are centered along the width W2 of the lateral rail 104*c*, and the centers thereof spaced a length L6 from the interior side/edge of rail 104*c*. In one exemplary embodiment, the length L6 may be about 2.75 inches. In some embodiments, a space may be formed between the first goal bumpers 118*a*, 118*b* and corresponding recesses 122 and the interior side/edge lateral rail 104*b*, and a space may be formed between the second goal bumpers 118*c*, 118*d* and corresponding recesses 122 and the interior side/edge of rail 104*c*, as shown in FIG. 1. In one such exemplary embodiment, such spaces may be about ¼ inch long.

As shown in FIG. 1, in one exemplary layout of the mat 100, the system 10 includes first and second goal recesses 120. The goal recesses 120 may be extend at least partially though the mat 100 from the inner surface 102 toward the outer surface 101, as shown in FIGS. 1 and 6. In some embodiments, the goal recesses 120 may extend entirely through the thickness T1 of the mat 100, while in other embodiments the goal recesses 120 may extend only through a portion of the thickness T1 of the mat 100. In some embodiments, the goal recesses 120 may define a circular opening of a diameter D2 in the inner surface 120, and may be or cylindrical, as shown in FIGS. 1 and 5A-6. In one exemplary embodiment, the diameter D2 of the goal recesses 120 is about 4 inches. In some embodiments, the goal recesses 120 define a thickness T3. The thickness T3 of the goal recesses 120 may be about ½ inch.

As shown in FIG. 1, the first goal recess 120 may be flanked by the first goal bumpers 118*a*, 118*b* and the second goal recess 120 may be flanked by the second goal bumpers 118*c*, 118*d* (and their corresponding recesses 120). As shown in FIG. 1, in some embodiments, the first goal recess 120, the first goal bumper recesses 122 and the first goal bumpers 118*a*, 118*b* are positioned proximate to a first lateral side rail 104*b* within the gameplay portion 116, and the second goal recess 120, the second goal bumper recesses 122 and the second goal bumpers 118*c*, 118*d* are positioned proximate to a second lateral side rail 104*c* within the gameplay portion 116 that opposes the first lateral side rail 104*b*. As shown in FIG. 1, in some embodiments the first goal recess 120 abuts or extends at least to the first lateral side rail 104*b*, and the second goal recess 120 abuts or extends at least to the second lateral side rail 104*c*. As shown in FIG. 1, in some embodiments the first goal recess 120 intersects the first goal bumper recesses 120 (and the corresponding first goal bumpers 118*a*, 118*b*), and the second goal recess 120 intersects the second goal bumper recesses 120 (and the corresponding first goal bumpers 118*c*, 118*d*).

As shown in FIG. 1, the system 10 may include central bumpers or obstacles 118*e*-118*l* and corresponding recesses 122 within the gameplay portion 116 of the inner surface 102/mat 100. The central bumpers 118*e*-118*l* may and corresponding recesses 122 may be spaced into an in an array and positioned generally between first and second goal recesses 122. For example, in one embodiment as shown in FIG. 1, the system 10 may include bumpers 118*i* and 118*e* (and corresponding recesses 122) centered along the length L3 of the gameplay area 116 and spaced a width W6 from the center thereof to the interior edge of rails 104*a* and 104*d*, respectively. In one exemplary embodiment, the width W6 is about 18 inches. As shown in FIG. 1, the system 10 may include bumpers 118*g* and 118*k* (and corresponding recesses 122) centered along the width W3 the gameplay area 116 and spaced a length L6 from the center thereof to the interior edge of rails 104*b* and 104*c*, respectively. In one exemplary embodiment, the length L6 is about 34 inches. In one exemplary embodiment, the centers of the bumpers 118*i* and 118*e* (and corresponding recesses 122) may thereby be spaced from the centers of the bumpers 118*g* and 118*k* (and corresponding recesses 122), respectively, a width W7 of about 12 inches and a length L7 of about 13 inches.

As also shown in FIG. 1, the system 10 may include bumpers 118*f* and 118*j* (and corresponding recesses 122) spaced a width W8 from the toward the center of the gameplay portion 116 between the centers thereof and the centers of the bumpers 118*f* and 118*j*, respectively. Similarly, the system 10 may include bumpers 118*h* and 118*l* (and corresponding recesses 122) spaced a length L8 from the toward the center of the gameplay portion 116 between the centers thereof and the centers of the bumpers 118*g* and 118*k*, respectively. In one exemplary embodiment, width W 8 and the length L8 are about 6 inches. As shown in FIG. 1, in some embodiments the bumpers or obstacles 118*a*-118*l* may form an array in a cross pattern in a central portion of the gameplay area 116 of the inner surface 102 of the mat 100.

In some embodiments, the bumpers 118*a*-118 may be colored or include a color scheme with two differing colors corresponding to the two sets of player/team balls 106*a*, 106*b*. For example, bumpers 118*a*, 118*b*, 118*e*, 118*g*, 118*i*, and 118*k* may all be a first color corresponding to the first player/team balls 106*a*, and bumpers 118*c*, 118*d*, 118*f*, 118*h*, 118*j* and 118*l* may all be a second color that differs from the first color, corresponding to the second player/team balls 106*b*.

As shown in FIG. 1, set of balls 106*a* (e.g., five in this example) are placed on corresponding ball marks on the inner surface 102 of the mat 100 proximate to rail 104*b* in the gameplay area 116, and a second set balls 106*b* (e.g., five in this example) are placed on corresponding ball marks on the inner surface 102 of the mat 100 proximate to rail 104*c*. Each set balls 106*a* and 106*b* and corresponding corresponds to a respective player/team and indicates where the balls 106*a* and 106*b* of the player/team are to be situated to start gameplay. In one exemplary embodiment, a center ball mark for each player sits centered along the width W3 of the gameplay area 116 and spaced (e.g., about 10 inches on one embodiment) along the length L3 of gameplay area 116 from the interior edge of the adjacent rail 104*b* or 104*c*. As also shown in FIG. 1, two inner ball marks for each player are spaced on either side of the central mark along the width W3 of the gameplay area 116 and from the adjacent rail 104*b* or 104*c* (e.g., about 8 inches on one embodiment). In one embodiment, inner marks are spaced along the width W3 of the gameplay area 116 at about 13 inches on center, and outer inner marks are spaced, on center, at about 9 inches along the width W3 of the gameplay area 116 from the inner marks. The ball marks for the balls 106*a*, 106*b* may be silk-screened or otherwise formed on/in the inner surface 102. The marks of a given set of balls 106*a* or 106*b* may be a same color scheme as the balls 106*a*, 106*b* that are placed on them to start a game. In this regard, balls 106*a*, 106*b* of a given player/team are of a common color scheme. In one embodiment, a center ball for aligning with the center ball marks of each set of balls 106*a*, 106*b* may include a unique mark to indicate that it is the "center" ball.

A bumper golf game may be played on the system 10 when it is assembled or formed. In some embodiments, the system 10 may include the balls 106*a*, 106*b*. In some embodiments, the system 10 may include an instruction sheet that provides instructions on how to setup the system 10 and/or how to play a game with the system 10. In some embodiments, the system 10 may include putters.

The instruction sheet may identify the following rules and/or gameplay suggestions.

In some embodiments, the game may be played between two players, but team play is possible. To set up the game, a player uses the balls 106*a* of the same color scheme, and places the balls 106*a* on the ball marks on the playing surface 102 that match the color scheme. A player/team's balls start proximate a rail 104*b* or 104*c* and that player/team's goal is the goal on the opposite side of the playing field. The adjacent goal 120 is the opponent's goal. The ball of the balls 106*a* with the unique mark is placed on the center mark in front of the opponent's hole/goal 120. The other players sets up in the same fashion with the other balls 106*b* on the other side of the mat 100.

To start the game, both players can stand on the playing surface 102 and simultaneously putt their dotted ball (the center ball of the set of balls 106*a*, 106*b*) off of the rail 104*d* or 104*a* to their right or left, to attempt to score the ball in the hole/goal 120 on the opposite side of gameplay area 116. If both players putt their ball into their respective hole/goal 120 on this first shot, they repeat the procedure by hitting the ball to the left or right of the start mark and proceeding in the manner above with a simultaneous stroke. This repeats until one or both fails to make a shot. A player may not play any of the player's other balls 106*a*, 106*b* until the uniquely-marked center ball is successfully putted into the player's hole/goal 120.

If one player holes the first ball and the other player does not, the player hits any one of the player's remaining balls 106*a*, 106*b* next, and the other player cannot play until the first player fails to get a ball within the goal 120. Upon the player missing a shot, the other players putts, and then play continues with the player with the ball closest to the goal 120 putting the next putt. If both players miss the initial shot, the player whose ball is closest to the hole/goal 120 plays next. Play then continues with the player with the ball closest to the goal 120 shooting the next shot. The game is won by the first player that putts all their respective balls 106*a*, 106*b* into the respective goal 120.

The instruction sheet may identify additional and/or different rules and/or gameplay suggestions. For example, if either player blocks the path of an opponent's ball 106*a*, 106*b*, interfering with the ball's movement 106*a*, 106*b*, a penalty may be assessed or both players may restart the game. Because both players are likely to be standing in the gameplay area 116 near their balls to take a simultaneous shot to begin the game, there is the potential for interference to occur if the players are unable to move out of the way in time.

As another example, if a player accidentally moves a ball 106*a*, 106*b* during the game, it is placed back in its original position. In one embodiment, if a player putts a ball 106*a*, 106*b* and it leaves the gameplay area 116 (i.e., it travels over a rails 104*a*-104*d*), the ball is placed in the middle of the gameplay area 116 surrounded by the central bumpers 118*e*-118*l*. In some embodiments, a player putts a ball 106*a*, 106*b* causing the opponent's ball 106*a*, 106*b* to leave the playing field, the opponent's ball 106*a*, 106*b* is placed back in its original position. In some embodiments, if a player putts a ball 106*a*, 106*b* into the opponent's hole/goal 120, the ball 106*a*, 106*b* is placed in the middle of the gameplay area 116, and the opponent can remove any one of the opponent's balls 106*a*, 106*b* from the gameplay area 116, as if putted in a goal 120. As another example, if a player putts a ball 106*a*, 106*b* causing the opponent's ball 106*a*, 106*b* to go in either hole/goal 120, the opponent can remove that ball 106*a*, 106*b* as if holed.

The system 10 may involve, and the instruction sheet may identify, strategy to winning the game and/or enjoying the game. For example, there may be offensive strategies and defensive strategies. In some embodiments, the rules may allow (e.g., as indicated by the instruction sheet), for a player to hit the player's balls 106*a*, 106*b* into balls 106*a*, 106*b* of the opponent, for instance to block or change the position the opponent's balls 106*a*, 106*b* to the opponent's hole/goal 120.

Accordingly, methods of bumper golf gameplay and associated equipment are described herein with respect to a bumper golf game system 10. Pieces of equipment or components described above with respect to the system 10 to facilitate gameplay may be packaged and sold individually or together as a kit.

The term "about" as used herein with respect to dimensions of the bumper golf game system of the present disclosure is utilized to indicate that the respective dimension encompasses values that differ by 25% of the disclosed dimension (i.e., encompasses a range of dimensions from 25% less to 25% greater than the respective dimension). Where one or more ranges are referred to throughout this specification, each range is intended to be a shorthand format for presenting information, where the range is understood to encompass each discrete point within the range as if the same were fully set forth herein.

It is to be understood that the above description is intended to be illustrative, and not restrictive. Numerous changes and modifications may be made herein by one of ordinary skill in the art without departing from the general spirit and scope of the invention as defined by the following claims and the equivalents thereof. For example, the above-described embodiments (and/or aspects thereof) may be used in combination with each other. In addition, many modifications may be made to adapt a particular situation or material to the teachings of the various embodiments without departing from their scope. While the dimensions and types of materials described herein are intended to define the parameters of some various exemplary embodiments, they are by no means limiting and are merely exemplary. Many other embodiments will be apparent to those of skill in the art upon reviewing the above description. The scope of the various embodiments should, therefore, be determined with reference to the appended claims, along with the full scope of equivalents to which such claims are entitled.

Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure. It is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the disclosure may include only some of the described embodiments. Accordingly, the invention is not to be seen as limited by the foregoing description, but is only limited by the scope of the appended claims.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include" (and any form of include, such as "includes" and "including"), "contain" (and any form contain, such as "contains" and "containing"), and any other grammatical variant thereof, are open-ended linking verbs. As a result, a method or article that "comprises", "has", "includes" or "contains" one or more steps or elements possesses those one or more steps or elements, but is not limited to possessing only those one or more steps or elements. Likewise, a step of a method or an element of an article that "comprises", "has", "includes" or "contains" one or more features possesses those one or more features, but is not limited to possessing only those one or more features.

As used herein, the terms "comprising," "has," "including," "containing," and other grammatical variants thereof encompass the terms "consisting of" and "consisting essentially of."

The phrase "consisting essentially of" or grammatical variants thereof when used herein are to be taken as specifying the stated features, integers, steps or components but do not preclude the addition of one or more additional features, integers, steps, components or groups thereof but only if the additional features, integers, steps, components or groups thereof do not materially alter the basic and novel characteristics of the claimed compositions or methods.

Any and all publications cited in this specification are herein incorporated by reference as if each individual publication were specifically and individually indicated to be incorporated by reference herein as though fully set forth.

Subject matter incorporated by reference is not considered to be an alternative to any claim limitations, unless otherwise explicitly indicated.

I claim:

1. A bumper golf game system, comprising:

a flexible putting mat including an inner surface, an outer surface, a first goal recess extending at least partially through the mat from the inner surface, a second goal recess extending at least partially through the mat from the inner surface, an array of a plurality of central obstacle recesses extending at least partially through the mat from the inner surface positioned generally between the first and second goal recesses, a pair of first goal obstacle recesses extending at least partially through the mat from the inner surface that flank the first goal recess, and a pair of second goal obstacle recesses extending at least partially through the mat from the inner surface that flank the second goal recess;

a plurality of obstacles configured to removably mount within the plurality of central obstacle recesses and the first and second goal obstacle recesses and extend past the inner surface of the mat;

a plurality of rails configured to interconnect and overlie the inner surface of the mat to form a frame that bounds a portion of the inner surface of the mat that includes the plurality of central obstacles, the first goal obstacle recesses, and the second goal obstacle recesses, wherein, when a first pair of obstacles of the plurality of obstacles are mounted within the pair of first goal obstacle recesses, portions of the first pair of obstacles extend into the first goal recess, and wherein, when a second pair of obstacles of the plurality of obstacles are mounted within the pair of second goal obstacle recesses, portions of the second pair of obstacles extend into the second goal recess.

2. The system of claim 1, further comprising a plurality of balls for putting by a player with a putter on the inner surface of the mat within the bounded portion, the plurality of balls comprising a plurality of first balls of a first color scheme and a plurality of second balls of a second color scheme that differs from the first color scheme.

3. The system of claim 2, wherein the plurality of obstacles include a plurality of obstacles of the first color scheme for mounting within the first goal obstacle recess and some of the central obstacle recesses, and a plurality of obstacles of the second color scheme for mounting within the second goal obstacle recess and some of the central obstacle recesses.

4. The system of claim 2, wherein the inner surface of the mat includes a plurality of first visual indications positioned proximate to the first goal recess indicating an initial position of the plurality of balls of the first color scheme thereon for putting into the second goal recess, and the inner surface of the mat includes a plurality of second visual indications positioned proximate to the second goal recess indicating an initial position of the plurality of balls of the second color scheme thereon for putting into the first goal recess, wherein the first visual indications are spaced laterally across a width of the bounded portion of the inner surface of the mat and comprise at least a first lateral indication positioned laterally between a first lateral side of the bounded portion and a first goal obstacle recess of the pair of first goal obstacle recesses, at least a second lateral indication positioned laterally between a second lateral side of the bounded portion and a second goal obstacle recess of the pair of first goal obstacle recesses, and a first medial indication positioned laterally between the first and second goal obstacle recess of the pair of first goal obstacle recesses, and wherein the second visual indications are spaced laterally across a width of the bounded portion of the inner surface of the mat and comprise at least a third lateral indication positioned laterally between the first lateral side of the bounded portion and a third goal obstacle recess of the pair of second goal obstacle recesses, at least a fourth lateral indication positioned laterally between the second lateral side of the bounded portion and a fourth goal obstacle recess of the pair of second goal obstacle recesses, and a second medial indication positioned laterally between the third and fourth goal obstacle recess of the pair of second goal obstacle recesses.

5. The system of claim 1, wherein the first and second goal recesses are cylindrical recesses.

6. The system of claim 1, wherein the plurality of obstacles each form a convex outer surface.

7. The system of claim 1, wherein a cross-sectional shape and size of the plurality of central obstacle recesses and the first and second goal obstacle recesses corresponds to a cross-sectional shape and size of the portions of the plurality of obstacles that extend past the inner surface of the mat when the plurality of obstacles are mounted within the plurality of central obstacle recesses and the first and second goal obstacle recesses.

8. The system of claim 1, wherein the array of the plurality of central obstacle recesses form a cross pattern in a central portion of the bounded portion of the inner surface of the mat.

9. The system of claim 1, wherein the first goal recess intersects each of the first goal obstacle recesses such that the first goal recess and the first goal obstacle recesses are in direct communication with each other, and the second goal recess intersects each of the second goal obstacle recesses such that the second goal recess and the second goal obstacle recesses are in direct communication with each other.

10. The system of claim 9, wherein the first and second goal recesses and the first and second goal obstacle recesses extend entirely through the mat.

11. The system of claim 1, wherein the mat is formed of at least one sheet of material.

12. The system of claim 1, wherein the inner surface of the mat includes a visual indication indicating the positioning of the interconnected rails thereon to form the bounded portion.

13. The system of claim 1, wherein the interconnected rails form a continuous rectangular frame to form a rectangular bounded portion of the inner surface of the mat.

14. The system of claim 13, wherein the first goal recess and the first goal obstacle recesses are positioned proximate to a first lateral side of the rectangular bounded portion, and the second goal recess and the second goal obstacle recesses are positioned proximate to a second lateral side of the rectangular bounded portion that opposes the first lateral side thereof, and wherein a first lateral side portion of the plurality of rails extends directly over a portion of the first goal recess and a second lateral side portion of the plurality of rails extends directly over a portion of the second goal recess.

15. The system of claim 1, wherein the mat is reconfigurable between a storage configuration with the mat rolled up upon itself, and a playing configuration with the outer surface overlying a ground surface such that the inner surface is substantially planar.

16. The system of claim 1, further comprising a plurality of balls and an instruction sheet providing instructions of a method of at least two players playing a game with the system with the object of putting the plurality of balls on the inner surface within the bounded portion with a putter into the first or second goal recesses.

17. The system of claim 16, wherein the method indicted by the instruction sheet comprises:

arranging a plurality balls associated with a first player of a first color scheme on corresponding visual indictors on the inner surface of the mat that are proximate to the first goal recess, and arranging a plurality balls associated with a second player of a second color scheme that differ from the first color scheme on corresponding visual indictors on the inner surface of the mat that are proximate to the second goal recess;

the first player putting a first ball of the first color scheme into a first portion of the rails and toward the second goal recesses via a putter, and the second player putting a first ball of the second color scheme into a second portion of the rails and toward the first goal recesses via a putter, the first and second players putting the respective first balls substantially simultaneously;

if neither of the first balls are initially putted into the respective first or second goal recesses, the first and second players alternatingly putting their respective first ball via the putter until it is putted into the respective first or second goal recesses; and after the first balls are putted into the respective first or second goal recesses, the first and second players alternatingly putting their remaining associated balls until one of the players wins the game by putting all of their associated balls into the respective first or second goal recess.

18. A method of forming a bumper golf game, comprising:

arranging a flexible putting mat over a ground surface such that an inner surface of the mat forms a substantially planar surface, the mat comprising a first goal recess extending at least partially through the mat from the inner surface, a second goal recess extending at least partially through the mat from the inner surface, an array of a plurality of central obstacle recesses extending at least partially through the mat from the inner surface positioned generally between the first and second goal recesses, a pair of first goal obstacle recesses extending at least partially through the mat from the inner surface that flank the first goal recess, and a pair of second goal obstacle recesses extending at least partially through the mat from the inner surface that flank the second goal recess;

positioning obstacles within the plurality of central obstacle recesses and the first and second goal obstacle recesses such that the obstacles extend past the inner surface of the mat and a first pair of obstacles positioned within the pair of first goal obstacle recesses each extend into the first goal recess, and a second pair of obstacles of the plurality of obstacles positioned within the pair of second goal obstacle recesses each extend into the second goal recess; and interconnecting a plurality of rails on the inner surface of the mat to form a frame that bounds a portion of the inner surface of the mat that includes the plurality of central obstacles, the first goal obstacle recesses, and the second goal obstacle recesses.

19. The system of claim 18, wherein the first goal recess intersects with each of the first goal obstacle recesses such that the first goal recess and the first goal obstacle recesses are in direct communication with each other, and the second goal recess intersects with each of the second goal obstacle recesses such that the second goal recess and the second goal obstacle recesses are in direct communication with each other.

20. The system of claim 18, wherein interconnecting a plurality of rails on the inner surface of the mat comprises positioning a first portion of the plurality of rails on the inner surface of the mat such that it extends directly over a portion of the first goal recess, and positioning a second portion of the plurality of rails on the inner surface of the mat such that it extends directly over a portion of the second goal recess.

* * * * *